United States Patent [19]

Engel

[11] Patent Number: 5,050,666

[45] Date of Patent: Sep. 24, 1991

[54] OSCILLATION GEAR ASSEMBLY PROVIDED FOR A MOLD OF A CONTINUOUS CASTING PLANT

[75] Inventor: Kurt Engel, Florian, Austria

[73] Assignee: Voest-Alpine Industrieanlagenbau GmbH, Turmstrasse, Austria

[21] Appl. No.: 535,339

[22] Filed: Jun. 8, 1990

[30] Foreign Application Priority Data

Jun. 16, 1989 [DE] Fed. Rep. of Germany ..... 3919753

[51] Int. Cl.[5] ..... B22D 11/04

[52] U.S. Cl. ..... 164/416; 164/478

[58] Field of Search ..... 164/416, 478, 260, 71.1

[56] References Cited

U.S. PATENT DOCUMENTS 4,712,447 12/1987 Langner ..... 164/478

FOREIGN PATENT DOCUMENTS 2545386 9/1976 Fed. Rep. of Germany .

*Primary Examiner*—Kuang Y. Lin

*Attorney, Agent, or Firm*—Hopgood, Calimafde, Kalil, Blaustein & Judlowe

[57] ABSTRACT

An oscillation gear for a mold of a continuous casting plant includes an eccentric shaft and an eccentric sleeve surrounding the eccentric shaft and rotatable and fixable relative to the same. in order to provide for a space-saving structure requiring only few mechanically moving parts, both the eccentric shaft and the eccentric sleeve are each provided with at least one groove. The longitudinal axis of at least one of the grooves is oriented at an angle relative to the longitudinal axis of the eccentric shaft or eccentric sleeve, respectively. The longitudinal axes of the two grooves enclose an angle with each other. A force transmission element rotating commonly with the eccentric shaft or with the eccentric sleeve projects into each groove, the force transmission elements being mutually coupled.

15 Claims, 3 Drawing Sheets

OSCILLATION GEAR ASSEMBLY PROVIDED FOR A MOLD OF A CONTINUOUS CASTING PLANT

The invention relates to an oscillation gear for a mold of a continuous casting plant, comprising an eccentric shaft and an eccentric sleeve surrounding the eccentric shaft and supported on the eccentric portion of the same, which eccentric sleeve is rotatable and fixable relative to the eccentric shaft, wherein either the eccentric shaft or the eccentric sleeve is stationarily supported in a rotational manner and either the eccentric shaft or the eccentric sleeve is drivable by means of a rotation drive, the mold being supported on the eccentric shaft or eccentric sleeve, respectively, that is stationarily unsupported.

In continuous casting plants, in particular continuous steel casting plants, it is necessary to allow the open-ended mold to oscillate in the direction of the axis of the mold cavity, i.a., in order to prevent the shell from adhering to the mold side walls and to obtain a perfect surface of the cast strand. This holds both for the vertical and for the horizontal continuous casting techniques.

It has proved that the optimum oscillating conditions vary as a function of the steel quality and of the casting speed, not only the oscillation frequency, but also the oscillation amplitude having to be adapted to the respective operational conditions. As a rule, a variation of the oscillation frequency does not pose any problem, yet an arrangement that may effect a variation of the oscillation amplitude does involve considerable structural expenditures.

A construction of the intitially defined kind, which enables the adjustment of the oscillation amplitude during continuous casting, is known, for instance, from DE A 25 45 386. With this known oscillation gear, the adjusting mechanism for the oscillation drive comprises two angular gears, two worm gears as well as at least one clutch and the respective gear shafts and bearings. This known solution not only is very expensive in terms of structure, but also requires much space at a location of the continuous casting plant usually limited in space. In addition, the plurality and complexity of the mechanical parts impair the operational safety and also call for a cumbersome maintenance of the same. A breakdown of the oscillation drive would cause damage to the strand shell, involving the risk of a strand breakout.

The invention aims at avoiding these disadvantages and difficulties and has as its object to provide an arrangement of the initially defined kind, which enables the adjustment of the oscillation amplitude during continuous casting, yet requires only very little space and comprises only a slight number of mechanically moved parts. The structure according to the invention also is to be produced at low costs and to exhibit a high operational safety.

In accordance with the invention, this object is achieved in that both the eccentric shaft and the eccentric sleeve are each provided with at least one groove, the longitudinal axis of at least one of the grooves being oriented at an angle relative to the longitudinal axes of the eccentric shaft and of the eccentric sleeve, and the longitudinal axes of the two grooves enclosing an angle with each other, and in that a force transmission element rotating commonly with the eccentric shaft or with the eccentric sleeve projects into each groove, the force transmission elements being mutually coupled and forces coming from the eccentric shaft being transmissible into the eccentric sleeve and vice versa, and in that at least one force transmission element is movable in the direction of the longitudinal axis of the eccentric shaft and of the eccentric sleeve, by means of an adjustment drive and is fixable in predetermined positions.

The adjustment of the force transmission elements in the direction of the axes of the eccentric shaft and of eccentric sleeve causes the relative rotation of the eccentric sleeve relative to the eccentric shaft, thus changing the overall eccentricity resulting from the sum of the adjusted eccentricities of the eccentric shaft and of the eccentric sleeve. As soon as the force transmission elements have been fixed in the axial direction, the eccentric sleeve is held fast so as to be irrotational relative to the eccentric shaft such that the adjusted overall eccentricity is fixed and will not change.

In order that a slight course of adjustment will do for the force transmission elements, advantageously both the eccentric shaft and the eccentric sleeve are each provided with a groove oriented at an angle relative to the longitudinal axes of the eccentric shaft and of the eccentric sleeve, the angles being directed oppositely, measured from the longitudinal axis of the eccentric shaft and of the eccentric sleeve, respectively. Suitably, the angles between the grooves and the longitudinal axes of the eccentric shaft and of the eccentric sleeve are equally large.

Preferably, each groove extends along a helicoidal line, one helicoidal line being lefthanded and the other one being righthanded, the simple manufacture of the grooves, thus, being feasible.

A structurally simple design is characterized in that an undivided force transmission element common to both grooves projects into the grooves.

A particularly space saving structure results if the eccentric shaft is designed to be hollow and an adjusting rod projects into its interior, which adjusting rod is displaceable in the axial direction of the eccentric shaft by means of the adjustment drive and is provided with a force transmission element projecting into the grooves.

In this case, the adjusting rod suitably is provided with a head rotatable relative to the adjusting rod and supporting the force transmission element projecting into the grooves, wherein the adjusting rod is mounted so as to be rotatable relative to the eccentric shaft.

Another preferred embodiment is characterized in that the adjusting rod carries a head rigidly mounted to it.

In order to get by with force transmission elements as small as possible and in order to keep the displaceable adjusting rod and its adjustment drive free of forces derived from the eccentric shaft and from the eccentric sleeve, advantageously both the eccentric shaft and the eccentric sleeve are each provided with at least two parallel grooves arranged in a radially symmetrical manner.

A particularly sturdy structure that comes up to the extreme operational conditions prevailing in the vicinity of a continuous casting mold in an advantageous manner is characterized in that the eccentric shaft and the eccentric sleeve, in the region of the rod head, have diameters that are larger than those of their remaining parts, the eccentric shaft and the eccentric sleeve advantageously having larger wall thicknesses in the region of the rod head than in their remaining parts.

Simple assemblage of the oscillation gear advantageously is provided if the eccentric shaft and the eccentric sleeve are formed by hollow cylindrical bodies in the region of the rod head, which cylindrical bodies are connected by flanges with the consecutive portions of the eccentric shaft and of the eccentric sleeve, respectively.

A great operational safety and little maintenance work suitably are ensured in that the eccentric shaft and the eccentric sleeve are filled with oil in the region of the rod head, wherein the eccentric sleeve is surrounded by a protecting and sealing sleeve on its external side and the adjustment rod is sealed relative to the eccentric shaft and the eccentric shaft is sealed relative to the eccentric sleeve.

A structurally most simple construction is characterized in that the force transmission element(s) is/are designed as (a) pin(s) extending transverse to the longitudinal axes of the eccentric shaft and of the eccentric sleeve and projecting into the grooves, the pin diameter corresponding to the groove width.

Advantageously, the grooves each extend over a quarter of the circumference of the eccentric shaft and of the eccentric sleeve, the eccentric shaft and the eccentric sleeve, thus, being rotatable relative to each other by 180° such that the overall eccentricity is variable from a minimum resulting from the substraction of the eccentricities of the eccentric shaft and of the eccentric sleeve to a maximum resulting from the addition of these eccentricities.

The invention will be explained in more detail with reference to the accompanying drawing, wherein.

Figure 1:
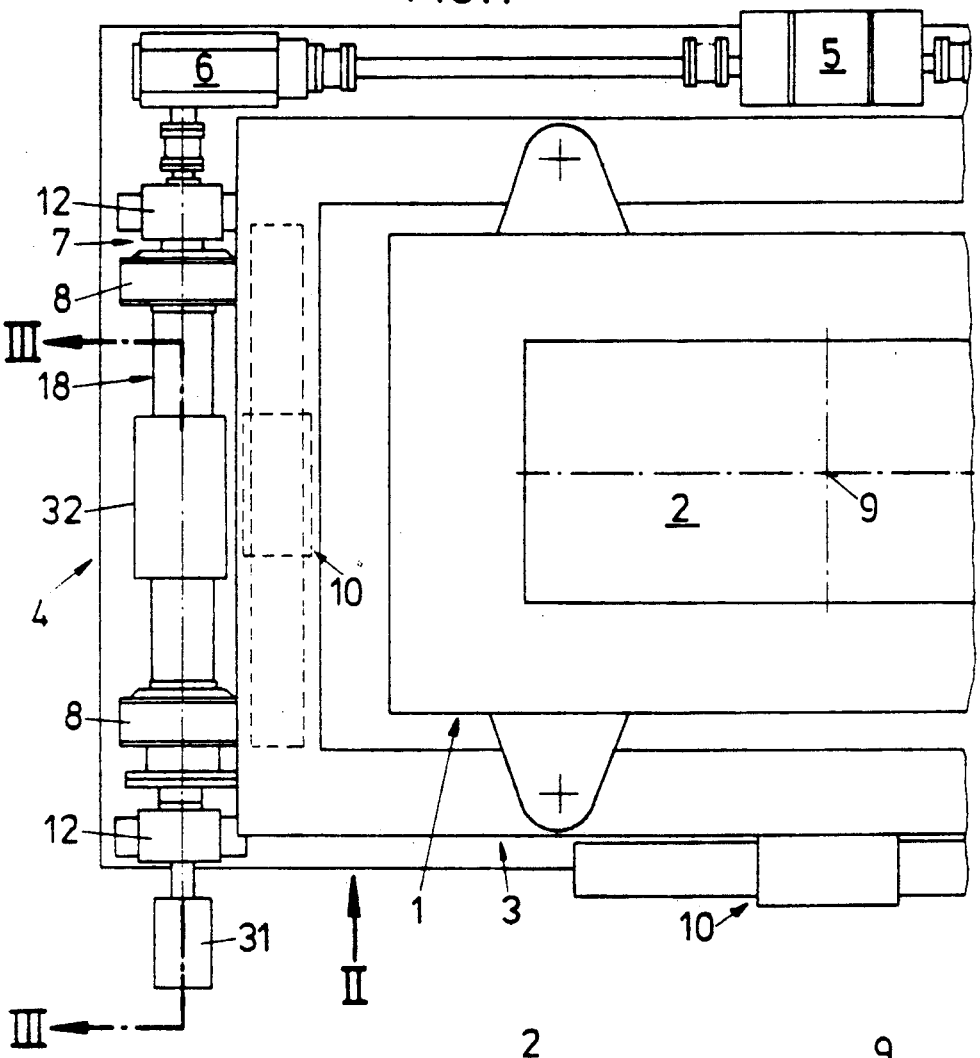
FIG. 1 is a top view onto a mold fastened to a lifting table.
Figure 2:
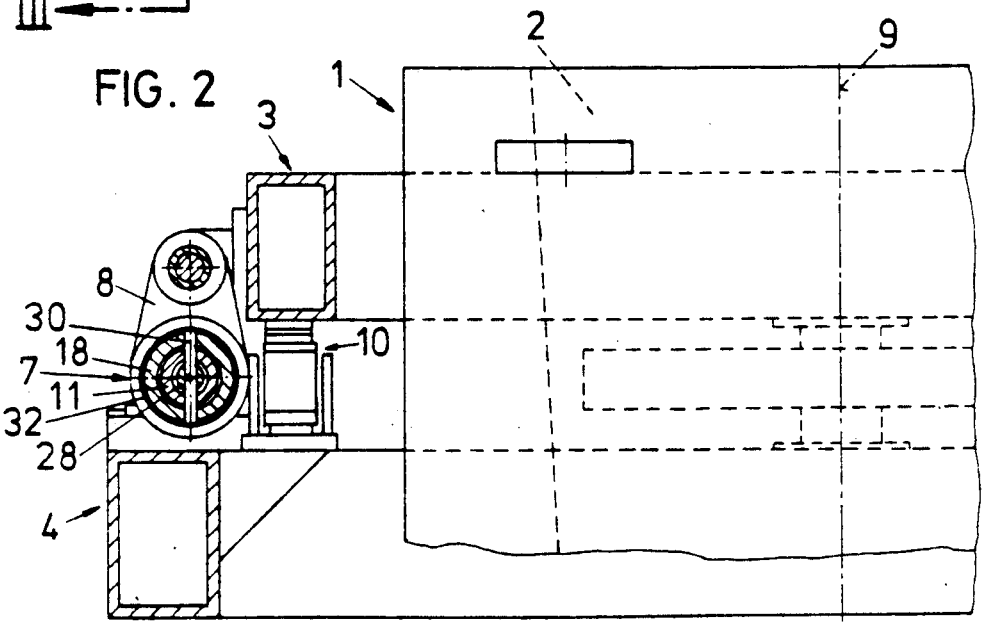
FIG. 2 is a partially sectioned side view in the direction of the arrow II of FIG. 1.

An open-ended continuous casting mold 1 having a straight mold cavity 2 is detachably fastened to a lifting table 3. The lifting table 3 performs a vertically oscillating movement relative to a stationary supporting structure 4. An oscillation drive 5 serves to produce this movement, driving oscillation gears 7 via corner gears 6, which oscillation gears impart vertically directed oscillations to the lifting table 3 via articulation brackets B.

In order to ensure a strictly vertical oscillating movement of the mold 1 without lateral shifting in a direction transverse to the vertical axis 9 of the mold cavity 2, the lifting table 3 is guided on the stationary supporting structure 4 by three vertical guiding means 10.

The oscillation gear comprises an eccentric shaft 11 set in rotational movement by the oscillation drive 5 at the desired oscillation frequency. On its ends, the eccentric shaft 11 is rotatably journaled in stationarily supported bearings 12. It is designed in three parts, a central portion 13, which is designed as a hollow cylindrical body and has a larger external diameter and a greater wall thickness, being inserted between two registering end portions 14, 15 eccentrically with respect to the bearings 12 by an eccentricity $e_1$. This central portion 13 is fastened to flanges 16 provided on the end portions 14, 15, for instance, by means of screws.

The end portions of the eccentric shaft 11 comprise eccentric collars 17 closely beside the stationary bearings 12, which have the same eccentricity $e_1$ (in terms of dimension and direction) as the central portion 13.

An eccentric sleeve 18 is rotatably mounted on each eccentric collar 17 of the eccentric shaft 11, which eccentric sleeve is designed in three parts similar to the eccentric shaft, comprising a central portion 21 arranged between end portions 19, 20 and likewisely designed as a hollow cylindrical body so as to surround the central portion 13 of the eccentric shaft 11 on its external side. The end portions 19, 20 of the eccentric sleeve 18 include eccentric portions 22, which are internally mounted on the eccentric collars 17 of the eccentric shaft 11. The eccentric portions 22 of the eccentric sleeve have an eccentricity $e_2$ relative to the exterior surfaces of the eccentric collars 17.

The articulation brackets 8, which are articulately connected to the lifting table 3 of the mold 1, are rotatably mounted on the external sides of the these eccentric portions 22 of the eccentric sleeve 18, vertically oscillating the lifting table 3 at a synchronous rotation of the eccentric sleeve 18 and the eccentric shaft 11. Suitably, the central portion 21 of the eccentric sleeve 18 is supported on the central portion 13 of the eccentric shaft 11, e.g., by means of slide bearings 23, i.e., the central portion 21 of the eccentric sleeve 18 has an internal diameter adapted to the external diameter of the eccentric shaft 11.

Figure 4:
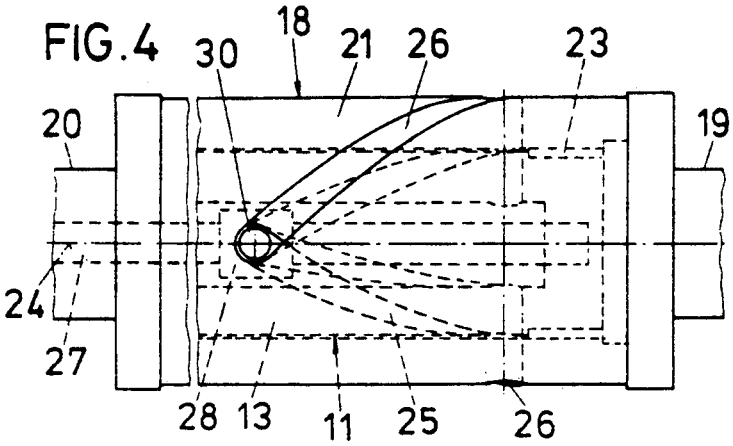
FIGS. 4 to 6 represent various adjustments of the overall eccentricity, FIGS. 4*a* to 6*a* each being a schematic side view pertaining to FIGS. 4 to 6, respectively.
Figure 4A:
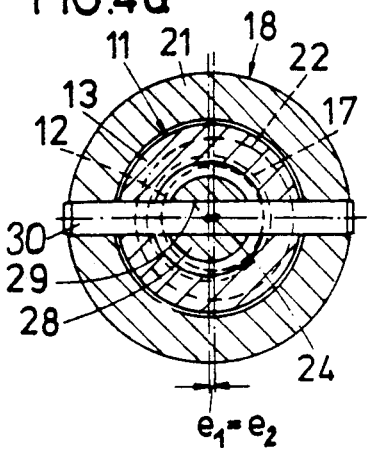
Figure 5:
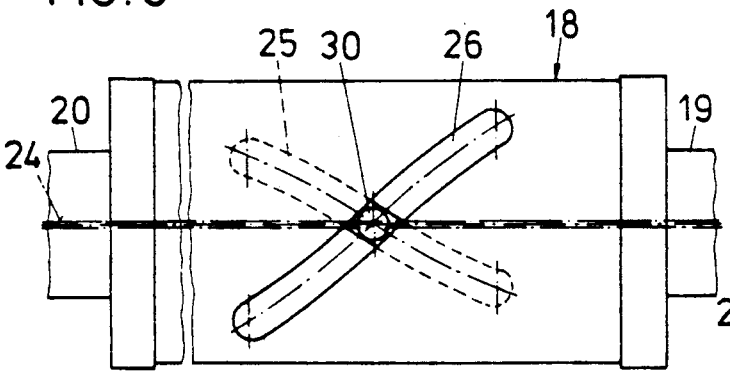
Figure 5A:
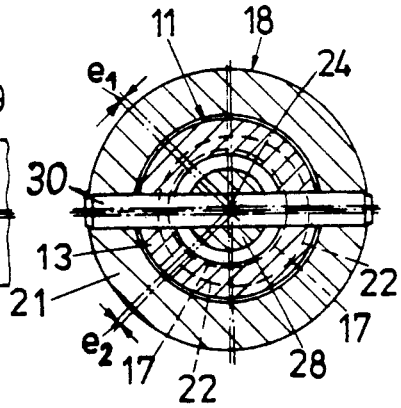
Figure 6:
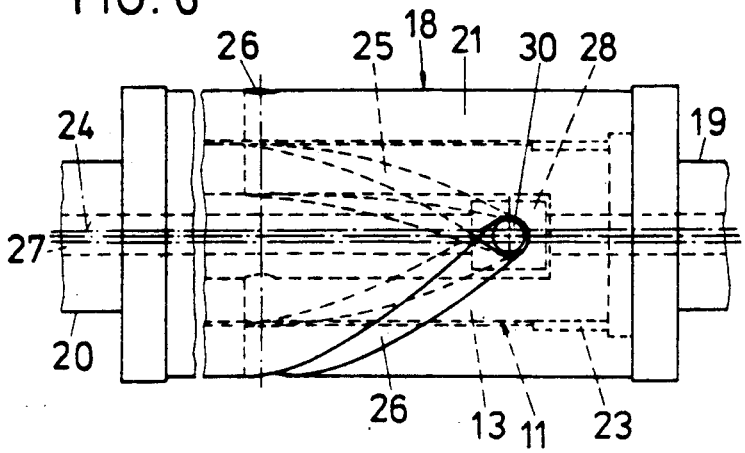
Figure 6A:
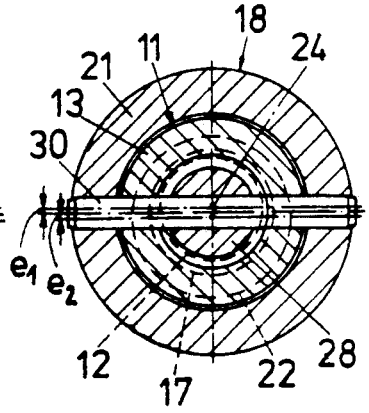

The central portions 13 and 21 of the eccentric shaft 11 and of the eccentric sleeve 18, respectively, are provided with grooves 25, 26 arranged helicoidally with respect to the axis 24 of the oscillation gear and having equal pitches, the helicoidal grooves 25 of the eccentric shaft 11 being threaded in a sense opposite to the helicoidal grooves 26 of the eccentric sleeve 18 such that the grooves 25 and 26 cross each other, as is apparent from FIGS. 4 to 6. In the exemplary embodiment illustrated, two parallel grooves 25 offset relative to each other by 180° are provided in the central portion 13 of the eccentric shaft 11. Accordingly, two parallel grooves 26 extending radially symmetrical are provided on the central portion 21 of the eccentric sleeve 18.

In the exemplary embodiment illustrated, the eccentric shaft 11 is hollow-shaped, an adjustment rod 27 being arranged in its interior. In the region of the central portion 13 of the eccentric shaft 11, this rod carries a head 28 rigidly fastened to it and provided with a transverse bore 29. This transverse bore 29 comprises a floatingly mounted pin 30 penetrating the grooves 25 and 26. This pin 30 functions as a force transmission element for forces derived from the grooves, i.e., it receives forces from one groove, e.g., of the eccentric shaft 11, and conducts them into the eccentric sleeve 18 via the groove 26 of the same such that the eccentric sleeve 18 will rotate synchronously with the eccentric shaft 11 if the adjustment rod is axially immobilized.

The adjustment rod 27 projects outwardly through one end of the eccentric shaft 11 and is adjustable in the longitudinal direction by means of an adjustment drive 31. Thereby, the eccentric shaft 11 is rotated relative to the eccentric sleeve 18 such that the eccentricities $e_1$ and $e_2$ of the eccentric shaft 11 and of the eccentric sleeve 18, respectively, may assume different positions relative to each other, as is illustrated in FIGS. 4 to 6 in connection with FIGS. 4*a* to 6*a*.

Suitably, the grooves 25, 26 each extend over a quarter of the circumference of the central portions 13 and 21 of the eccentric shaft 11 and of the eccentric sleeve 18, respectively, thus enabling the rotation of the eccentric shaft 11 relative to the eccentric sleeve 18 by 180°. Thereby, the eccentricities $e_1$ and $e_2$ can be brought into positions in which they are oriented in the opposite sense, whereby the lift of the lifting table 3, which corresponds to the overall eccentricity of the oscillation gear 7, i.e., the sum or the difference of the eccentricity $e_1$ and of the projection of the eccentricity $e_2$ on $e_1$, can be minimized. If the eccentricities $e_1$ and $e_2$ are equal, a lift of zero can be adjusted (FIG. 4, 4*a*). On the other hand, by turning the eccentric shaft 11 relative to the eccentric sleeve 18, the eccentricities $e_1$ and $e_2$ can be brought into positions in which they are oriented in the same direction: hence results the maximum lift to be adjusted (cf. FIGS. 6, 6*a*).

Suitably, the volume within the central portion 13 is filled with oil in order to ensure the operation of the oscillation gear with as little maintenance work as possible. Sealing means (not illustrated) provided on the eccentric shaft 11 and on the eccentric sleeve 18 prevent oil from leaking. The central portion 21 of the eccentric sleeve 18, on its external side, is surrounded by a sleeve 32 in an oil tight manner.

Figure 3:
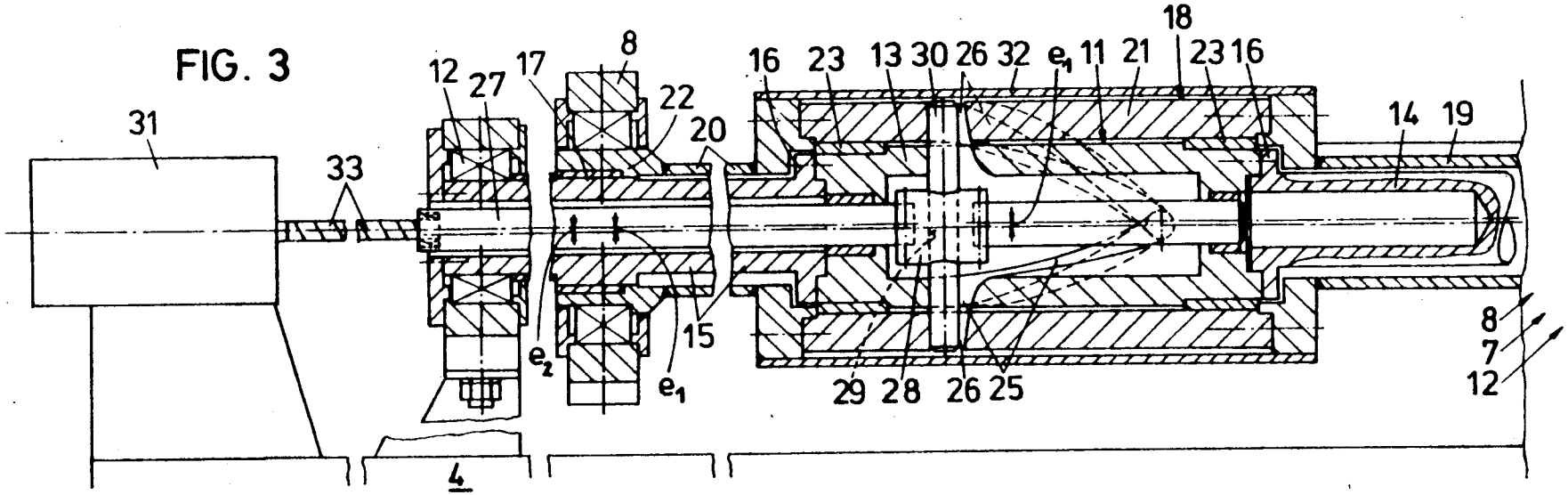
FIG. 3 illustrates a section according to line III—III of FIG. 1 according to a first embodiment.

In the embodiment illustrated in FIG. 3, the adjusting rod 27 co rotates with the eccentric shaft 11 as the latter is driven, for which reason the adjustment drive 31 contacts the same via a pivot bearing for displacing the adjustment rod 27 . The adjustment drive 31 for displacing the adjusting rod 27 may comprise a manual drive or an electromotor or a hydraulic drive effecting the displacement of the adjusting rod 27 via a spindle 33. Advantageously, the adjustment drive 31 is self locking such that forces acting on the pin 30 do not cause the automatic displacement of the adjusting rod 27, i.e., the adjusting rod is fixed in its longitudinal position at a stop of the adjustment drive 31.

Figure 7:
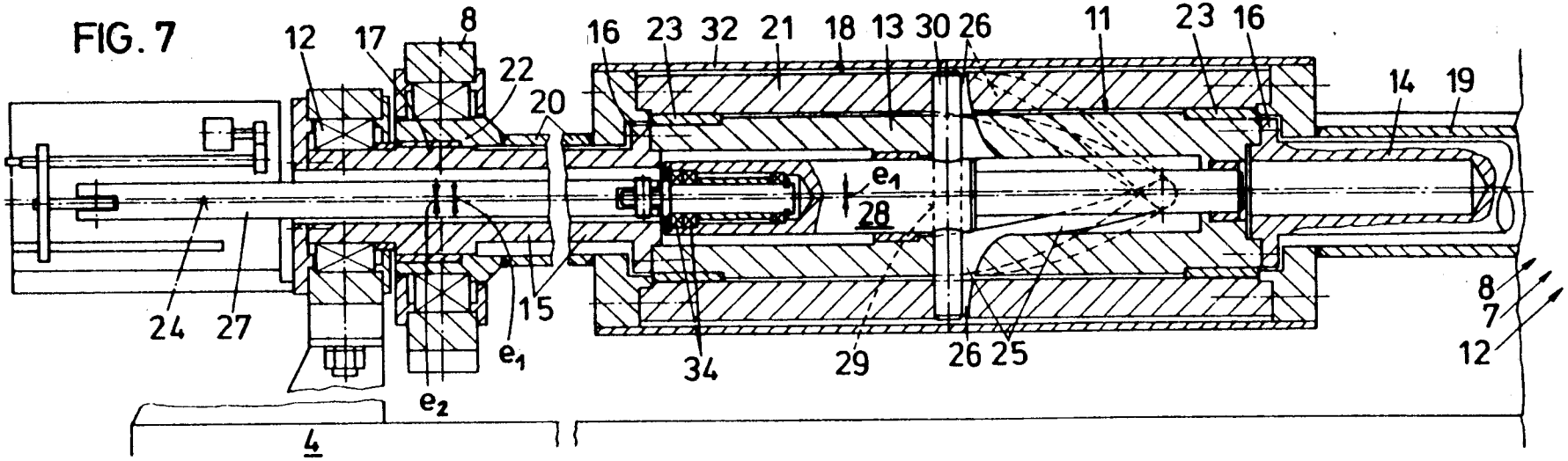
FIG. 7 represents another embodiment in an illustration analogous to FIG. 3.

According to the embodiment represented in FIG. 7, the head 28 provided in the central portion 13 of the eccentric shaft 11 is rotatably mounted on the adjusting rod 27 via thrust bearings 34, the drive mechanism for displacing the adjusting rod, thus, being particularly simple to realize and capable of contacting the same directly by means of an adjustment spindle.

The invention is not limited to the embodiments illustrated in the drawing, but may be modified in various aspects without departing from the scope of the invention. For instance, any number of grooves 25, 26 may be chosen, and it is also possible to do with a single groove both in the eccentric shaft and in the eccentric sleeve: yet, the rotationally symmetric arrangement of the grooves is of a particular advantage, because the balance of force is ensured thereby and no moments are introduced into the adjusting rod.

Also any pitch of the grooves may be chosen according to the lift or overall eccentricity to be adjusted, thus, for instance, the grooves of the eccentric shaft and of the eccentric sleeve may extend parallel to the axis 24. What is essential is that the groove(s) of the eccentric shaft 11 cross(es) with the groove(s) of the eccentric sleeve 18.

Positioning of the adjusting rod 27 may be effected in a simple manner by means of a hand wheel. However, actuation from a central place is also feasible such that no manipulations are required in the vicinity of the continuous casting mold. The position of the adjusting rod and, thus, the overall eccentricity may be determined, for instance, by means of a marking provided on the same. On the other hand, it is possible to install electronic position sensors.

The force transmission element, which is comprised of a pin 30 in the embodiments illustrated, may have any other shape, and it is also possible to allow a separate force transmission element to project into each of the grooves 25, 26 and to adjust the force transmission elements individually or commonly. If several force transmission elements are provided, these are to be coupled in a manner that forces derived from the eccentric shaft 11 may be transmitted to the eccentric sleeve 18, and vice versa, such that a synchronous rotational movement of the eccentric shaft 11 and of the eccentric sleeve 18 is possible with the adjusting rod 27 fixed in the axial direction.

Instead of the adjusting rod 27 arranged in the interior of the eccentric shaft 11, an adjusting element may be arranged also outside the eccentric sleeve 18, being equipped with force transmission elements reaching into the grooves. However, the adjusting rod arranged within the eccentric shaft 11 has proved particularly space-saving. Besides, this constitutes a well protecting accommodation for the adjustment mechanism.

The grooves 25, 26 enable the most precise adjustment of the lift of the mold if the pitch of the grooves is very large, which results in a high transmission rate, i.e., a relatively long axial course of the adjusting rod causes a relatively slight rotation of the eccentric sleeve 18 relative to the eccentric shaft 11.

What I claim is:

1. In a continuous casting mold assembly and an oscillation gear assembly therefor, wherein said mold and gear assemblies are stationarily supported on an oscillatable table, wherein said oscillation gear assembly comprises a rotatable longitudinally disposed eccentrically mounted shaft of a first diameter and a rotatable eccentrically mounted sleeve of a second diameter surrounding and supported by said shaft, said shaft and sleeve as an assembly being disposed along the same longitudinal axis, wherein said oscillation assembly includes gear drive means for rotating said eccentrically mounted shaft and sleeve, and wherein the relative eccentricities of said shaft and sleeve assembly are rotationally coordinated one with respect to the other to provide a desired amplitude for vibrating said mold in the direction of its vertical axis, the improvement comprising:

at least one elongated groove on each of said eccentrically mounted shaft and eccentrically mounted sleeve, an adjustment rod passing longitudinally and concentrically through said shaft, drive means cooperably associated at one end of said rod for applying a force to said rod to displace it along its longitudinal axis and/or to rotate said rod, and force-transmission means located on said rod co-actable with said grooves for applying a rotational force to one or both of said shaft and sleeve, whereby the eccentricity of each of said shaft and sleeve is rotationally coordinated by said force-transmission means one with respect to the other to provide a range of amplitudes as desired for vibrating the oscillatable table and hence the mold in the direction of its vertical axis.

2. The oscillation gear assembly as set forth in claim 1, wherein said at least one groove on said shaft is disposed at an angle relative to said at least one groove on said sleeve and to said longitudinal axis.

3. The oscillation gear assembly as set forth in claim 2, wherein each of said shaft and sleeve contains one groove.

4. The oscillation gear assembly as set forth in claim 3, wherein said elongated groove of said shaft and the elongated groove of said sleeve each extend along a helical path, one being configurated as a lefthand thread and the other being configurated as a righthand thread.

5. The oscillation gear assembly as set forth in claim 7, wherein said adjustment rod has a single force transmission means which projects into said grooves.

6. The oscillation gear assembly as set forth in claim 5, wherein said eccentric shaft is hollow of varying wall thicknesses and defines an eccentric shaft interior, and wherein the force-transmission means of said adjustment rod projects into the grooves of said eccentric shaft interior and said sleeve, said adjustment rod being displaceable by said rod drive means in the direction of the longitudinal axis of said shaft and with it the force transmission means projecting into said grooves.

7. The oscillation gear assembly as set forth in claim 6, further comprising an adjustment rod head disposed on said adjustment rod so as to be rotatable relative to said adjustment rod, said head supporting said force transmission means projecting into each of said grooves, and wherein said adjustment rod is rotatably mounted relative to said eccentric shaft.

8. An oscillation gear assembly as set forth in claim 7, further comprising an adjustment rod head rigidly mounted to said adjustment rod.

9. The oscillation gear assembly as set forth in claim 7, wherein said groove means comprises at least two parallel eccentric shaft grooves and at least two parallel eccentric sleeve grooves arranged in a radially symmetric manner.

10. The oscillation gear assembly as set forth in claim 7, wherein said eccentric shaft and said eccentric sleeve each include an adjustment rod head region having a diameter larger than the remaining diameters of said shaft and sleeve.

11. The oscillation gear assembly as set forth in claim 10, wherein said eccentric shaft and said eccentric sleeve, in the region of the adjustment rod head, each have a wall thickness larger than remaining wall thicknesses of said shaft and sleeve.

12. The oscillation gear assembly as set forth in claim 10 or 11, wherein said eccentric shaft and said eccentric sleeve are comprised of interconnected hollow cylindrical members in said adjustment rod head region, including consecutive portions following thereof, including flanges connecting each of said hollow cylindrical member of each of said shaft and sleeve.

13. The oscillation gear assembly as set forth in claim 10 or 11, wherein said eccentric shaft and said eccentric sleeve are filled with oil in said adjustment rod head region, and further comprising a protecting and sealing sleeve surrounding said eccentric sleeve on its external side, said adjustment rod being sealed relative to said eccentric shaft and said eccentric shaft being sealed relative to said eccentric sleeve.

14. An oscillation gear assembly as set forth in claim 7, wherein said force transmission means is a pin extending transverse to the longitudinal axes of said eccentric shaft and said eccentric sleeve and extending into said grooves, said pin having a diameter corresponding substantially to the width of said groove means.

15. An oscillation gear assembly as set forth in claim 7, wherein said grooves each extend over about one fourth of the circumferences of said eccentric shaft and said eccentric sleeve.

* * * * *

UNITED STATES PATENT AND TRADEMARK OFFICE

CERTIFICATE OF CORRECTION

PATENT NO. : 5,050,666

DATED : September 24, 1991

INVENTOR(S) : Kurt Engel

It is certified that error appears in the above-identified patent and that said Letters Patent is hereby corrected as shown below:

Column 7:
Claim 5, lines 1 and 2, "claim 7"
should be --claim 1--;

Column 8:
Claim 14, lines 1 and 2, "claim 7"
should be --claim 1--; and

Column 8:
Claim 15, lines 1 and 2, "claim 7"
should be --claim 1--.

Title Page:
In the fourth line of the Abstract, "in"
should be --In--.

Signed and Sealed this

Second Day of March, 1993

*Attest:*

STEPHEN G. KUNIN

*Attesting Officer*

*Acting Commissioner of Patents and Trademarks*